US010767454B2

(12) United States Patent
Wright et al.

(10) Patent No.: US 10,767,454 B2
(45) Date of Patent: Sep. 8, 2020

(54) MULTI-POSITION INFLOW CONTROL DEVICE

(71) Applicant: Halliburton Energy Services, Inc., Houston, TX (US)

(72) Inventors: Austin Wright, Dallas, TX (US); Ryan Wesley McChesney, Prosper, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 382 days.

(21) Appl. No.: 15/751,328

(22) PCT Filed: Apr. 12, 2017

(86) PCT No.: PCT/US2017/027118
§ 371 (c)(1),
(2) Date: Feb. 8, 2018

(87) PCT Pub. No.: WO2018/190819
PCT Pub. Date: Oct. 18, 2018

(65) Prior Publication Data

US 2020/0199984 A1 Jun. 25, 2020

(51) Int. Cl.
*E21B 43/12* (2006.01)
*E21B 34/14* (2006.01)
(Continued)

(52) U.S. Cl.
CPC ..... *E21B 43/12* (2013.01); *E21B 34/14* (2013.01); *E21B 34/10* (2013.01); *E21B 43/08* (2013.01); *E21B 43/32* (2013.01); *E21B 2200/06* (2020.05)

(58) Field of Classification Search
CPC ..... E21B 34/14; E21B 43/12
See application file for complete search history.

(56) References Cited

U.S. PATENT DOCUMENTS 5,896,928 A 4/1999 Coon
6,722,439 B2 4/2004 Garay et al.
(Continued)

FOREIGN PATENT DOCUMENTS

AU 2003224704 B2 10/2003
CA 2809804 A1 6/2014
(Continued)

OTHER PUBLICATIONS

International Search Report and Written Opinion for International Application PCT/US2017/027118 issued by the Korean Intellectual Property Office dated Jan. 11, 2018, 15 pages.

*Primary Examiner* — Shane Bomar
(74) *Attorney, Agent, or Firm* — Haynes and Boone, LLP

(57) ABSTRACT

A method of controlling a flow of a fluid through an inflow control device comprising a tubular within which a sliding sleeve having a longitudinal fluid passageway extends, the method includes longitudinally shifting the sliding sleeve, relative to the tubular, into a first, second, or third position, with each position associated with a different pressure differential between an external pressure applied to an external surface of the tubular with an internal pressure within the longitudinal fluid passage, and selecting a first, second, or third flow setting that corresponds with the first, second, and third pressure differential, respectively, at a surface of a well in which the inflow control device is received.

20 Claims, 11 Drawing Sheets

(51) Int. Cl.

| | |
|---|---|
| *E21B 43/08* | (2006.01) |
| *E21B 43/32* | (2006.01) |
| *E21B 34/10* | (2006.01) |

(56) References Cited

U.S. PATENT DOCUMENTS

| | | | | |
|---|---|---|---|---|
| 7,971,646 | B2 | 7/2011 | Murray et al. | |
| 8,469,107 | B2 | 6/2013 | O'Malley et al. | |
| 9,080,421 | B2 | 7/2015 | Holderman et al. | |
| 2002/0189815 | A1 | 12/2002 | Johnson et al. | |
| 2004/0094307 | A1 | 5/2004 | Daling et al. | |
| 2004/0154798 | A1 | 8/2004 | Vincent et al. | |
| 2009/0008092 | A1* | 1/2009 | Haeberle | E21B 43/08 166/278 |
| 2009/0205834 | A1 | 8/2009 | Garcia et al. | |
| 2010/0000727 | A1* | 1/2010 | Webb | E21B 43/114 166/135 |
| 2011/0147007 | A1* | 6/2011 | O'Malley | E21B 23/004 166/373 |
| 2014/0174746 | A1 | 6/2014 | George et al. | |
| 2014/0262324 | A1 | 9/2014 | Greci et al. | |
| 2015/0041148 | A1 | 2/2015 | Greenan | |
| 2015/0315883 | A1* | 11/2015 | Yeh | E21B 43/12 166/53 |
| 2016/0201431 | A1 | 7/2016 | Castillo et al. | |
| 2016/0273308 | A1* | 9/2016 | Williamson, Jr. | E21B 34/14 |

FOREIGN PATENT DOCUMENTS

| | | | |
|---|---|---|---|
| WO | 2013-130096 | A1 | 9/2013 |
| WO | 2016-114869 | A1 | 7/2016 |

* cited by examiner

MULTI-POSITION INFLOW CONTROL DEVICE

TECHNICAL FIELD

The present disclosure relates generally to an inflow control device of a flow regulating system that is run downhole, and more specifically, to an adjustable, multi-position inflow control device.

BACKGROUND

In the process of completing an oil or gas well, a tubular is run downhole and used to communicate produced hydrocarbon fluids from the formation to the surface. Typically, this tubular includes a screen assembly that controls and limits debris, such as gravel, sand, and other particulate matter, from entering the tubular. Occasionally, the screen assembly is coupled to a flow regulating system, including an inflow control device, which controls the flow of the fluid into the tubular. Differences in influx from the reservoir can result in premature water or gas breakthrough, leaving valuable reserves in the ground. Inflow Control Devices (ICDs) are designed to improve completion performance and efficiency by balancing inflow throughout the length of a completion. The inflow control device may have settings that are adjusted at the surface of the well, are finalized during the manufacturing of the inflow control device, or autonomously restrict flow based on fluid properties. Generally, the settings cannot be adjusted over the life of the well.

The present disclosure is directed to a multi-position inflow control device.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Illustrative embodiments and related methods of the present disclosure are described below as they might be employed in a pressure actuated inflow control device. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

Figure 1:
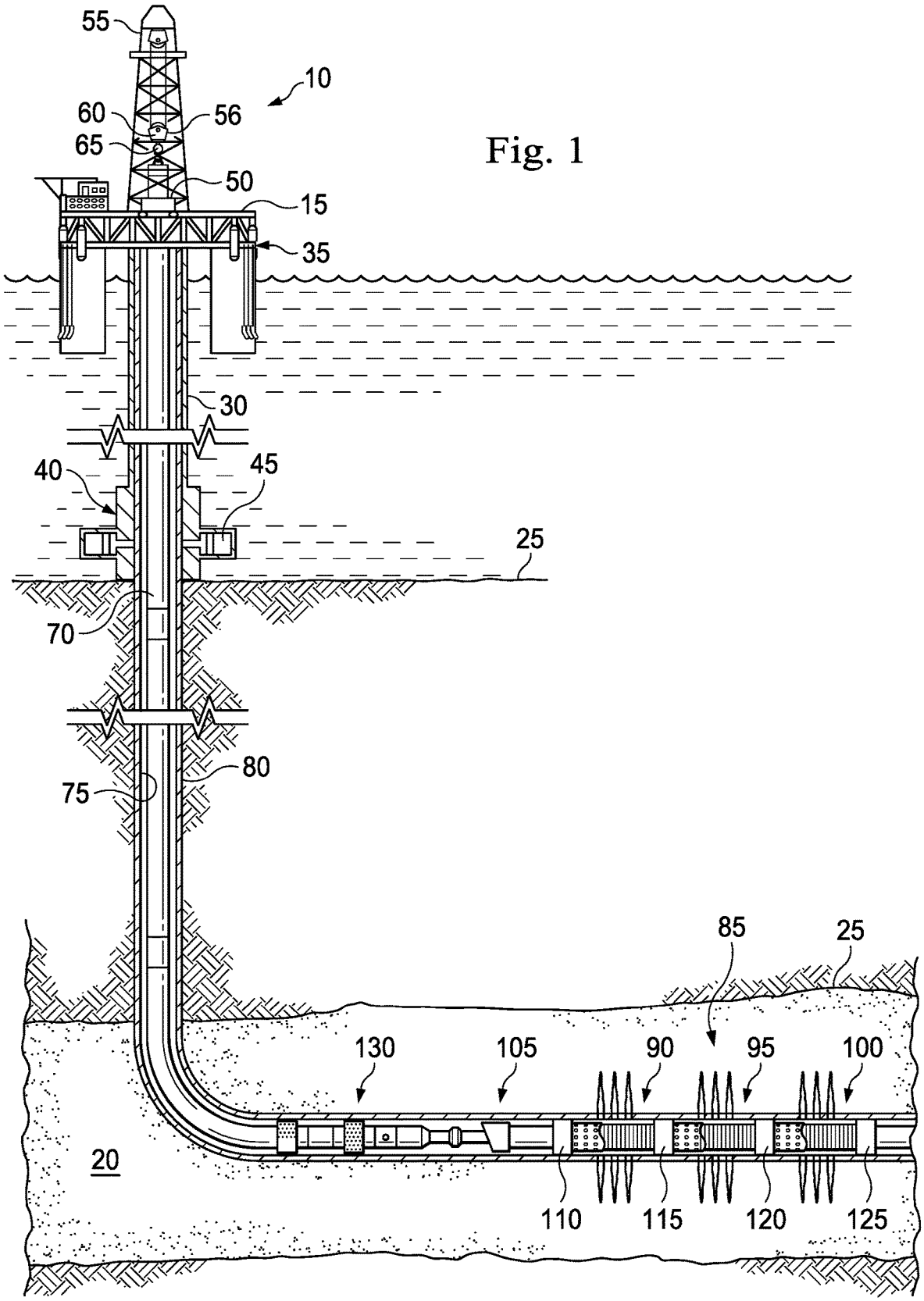
FIG. 1 is a schematic illustration of an offshore oil and gas platform operably coupled to a flow regulating system according to an embodiment of the present disclosure.

Referring initially to FIG. 1, an upper completion assembly is installed in a well having a lower completion assembly disposed therein from an offshore oil or gas platform that is schematically illustrated and generally designated 10. However, and in some cases, a single trip completion assembly (i.e., not having separate upper and lower completion assemblies) are installed in the well. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending tubing string 70.

A wellbore 75 extends through the various earth strata including the formation 20 and has a casing string 80 cemented therein. Disposed in a substantially horizontal portion of the wellbore 75 is a lower completion assembly 85 that includes at least one flow regulating system, such as flow regulating system 90 or flow regulating system 95 or 100, and may include various other components, such as a latch subassembly 105, a packer 110, a packer 115, a packer 120, and a packer 125.

Disposed in the wellbore 75 at a lower end of the tubing string 70 is an upper completion assembly 130 that couples to the latch subassembly 105 to place the upper completion assembly 130 and the tubing string 70 in communication with the lower completion assembly 85. In some embodiments, the latch subassembly 105 is omitted.

Even though FIG. 1 depicts a horizontal wellbore, it should be understood by those skilled in the art that the apparatus according to the present disclosure is equally well suited for use in wellbores having other orientations including vertical wellbores, slanted wellbores, uphill wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
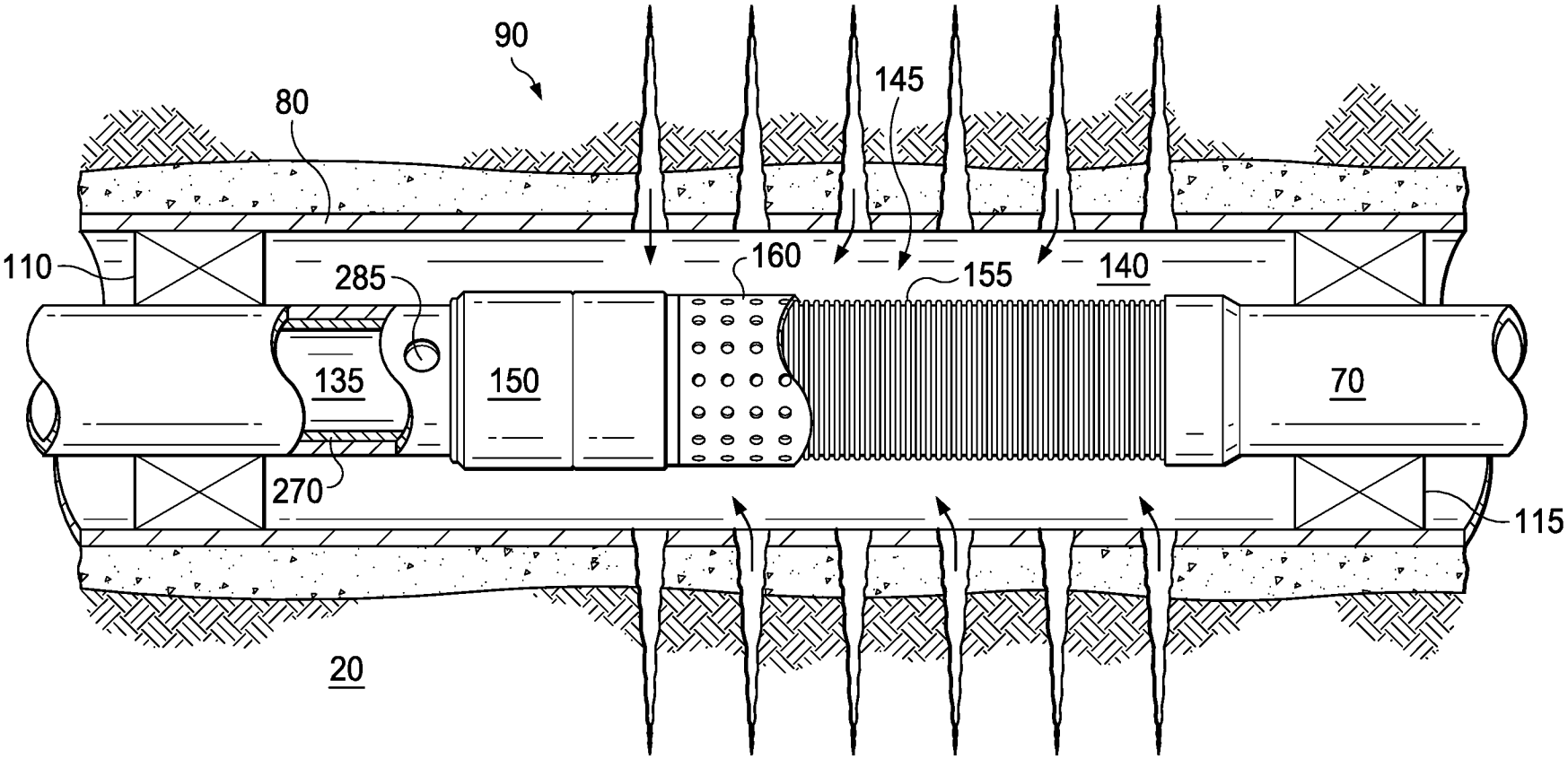
FIG. 2 illustrates a cut-out, side view of the flow regulating system of FIG. 1, according to an exemplary embodiment of the present disclosure.

FIG. 2 illustrates the flow regulating system 90 according to an exemplary embodiment. The flow regulating system 90 regulates flow of a fluid from the formation 20 to an interior flow passage 135 of the tubing string 70 (such as a production tubing string, liner string, etc.). As shown, an annulus 140 is formed radially between the tubing string 70 and the casing string 80. However, the annulus 140 may be formed radially between the tubing string 70 and the formation 20 when the casing string 80 is omitted in open hole completions. The fluid flows from the formation 20 into the interior flow passage 135 through the flow regulating system 90. The flow regulating system 90 generally includes a screen assembly 145 and an inflow control device ("ICD") 150. The screen assembly 145 prevents or at least reduces the amount of debris, such as gravel, sand, fines, and other particulate matter, from entering the interior flow passage 135. In one or more embodiments, the fluid passes through the screen assembly 145 then flows through the ICD 150 and into the interior flow passage 135 for eventual production to the surface. However, the ICD 150 may be used in a wide variety of assemblies, such as for example an assembly that is installed or used in an injector well. The screen assembly 145 may include an elongated tubular screen member 155 and a shroud 160 concentrically disposed about the elongated tubular screen member 155. However, in other embodiments, the screen member 155 and shroud 160 may be omitted from the ICD 150.

Figure 3:
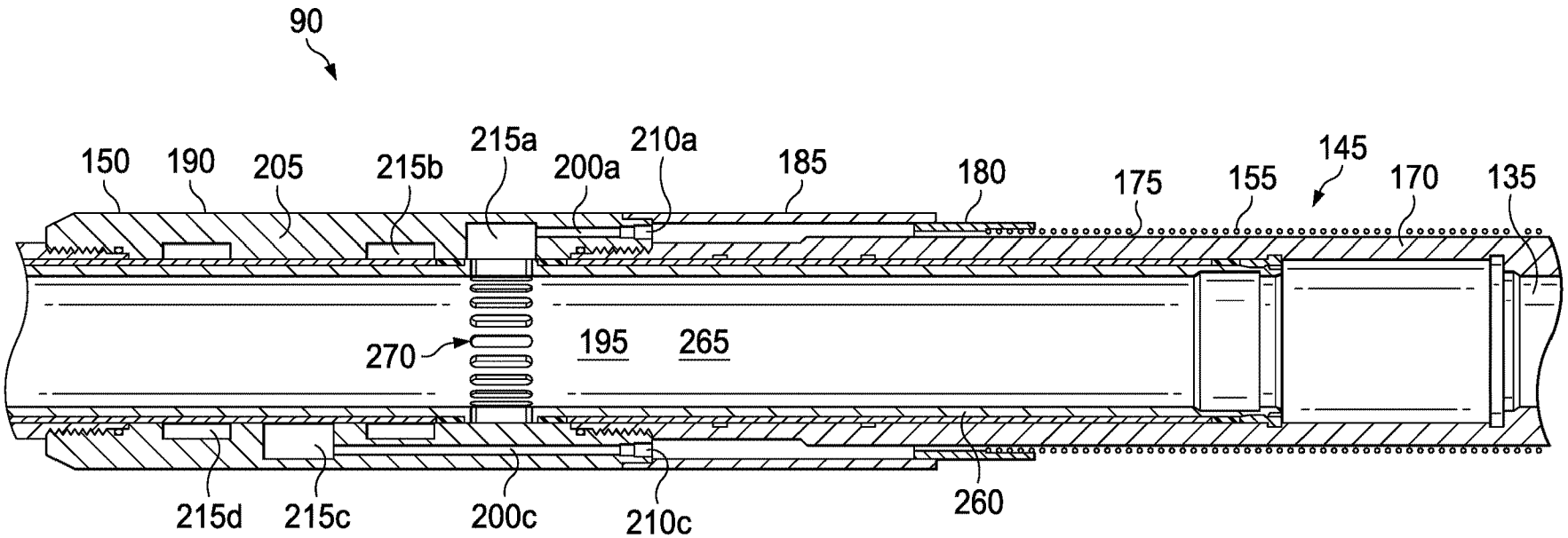
FIG. 3 illustrates a partial sectional view of the flow regulating system of FIG. 2 in a first configuration, according to an exemplary embodiment of the present disclosure.
Figure 4:
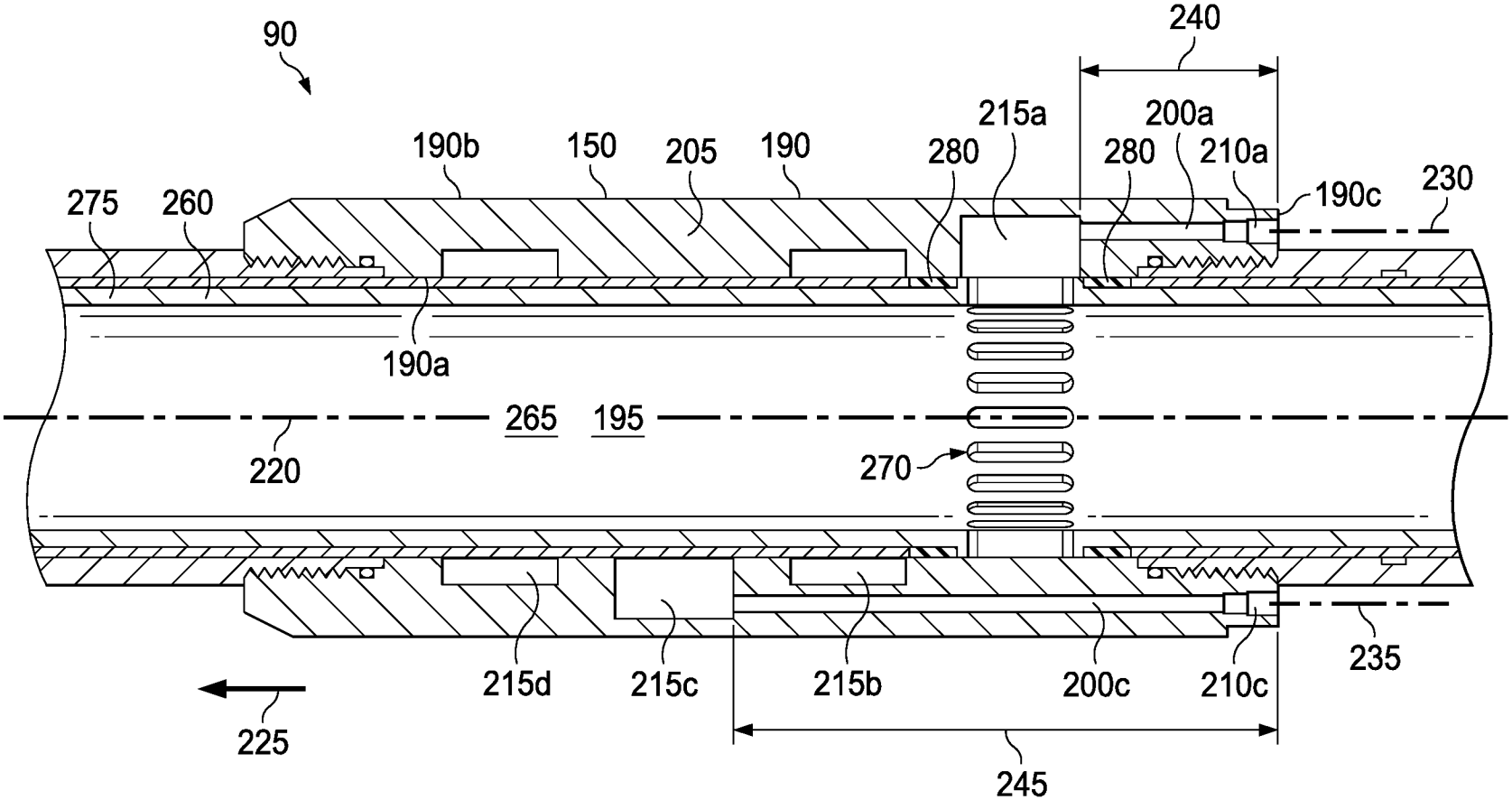
FIG. 4 illustrates another partial sectional view of the flow regulating system of FIG. 2, according to an exemplary embodiment of the present disclosure.
Figure 5:
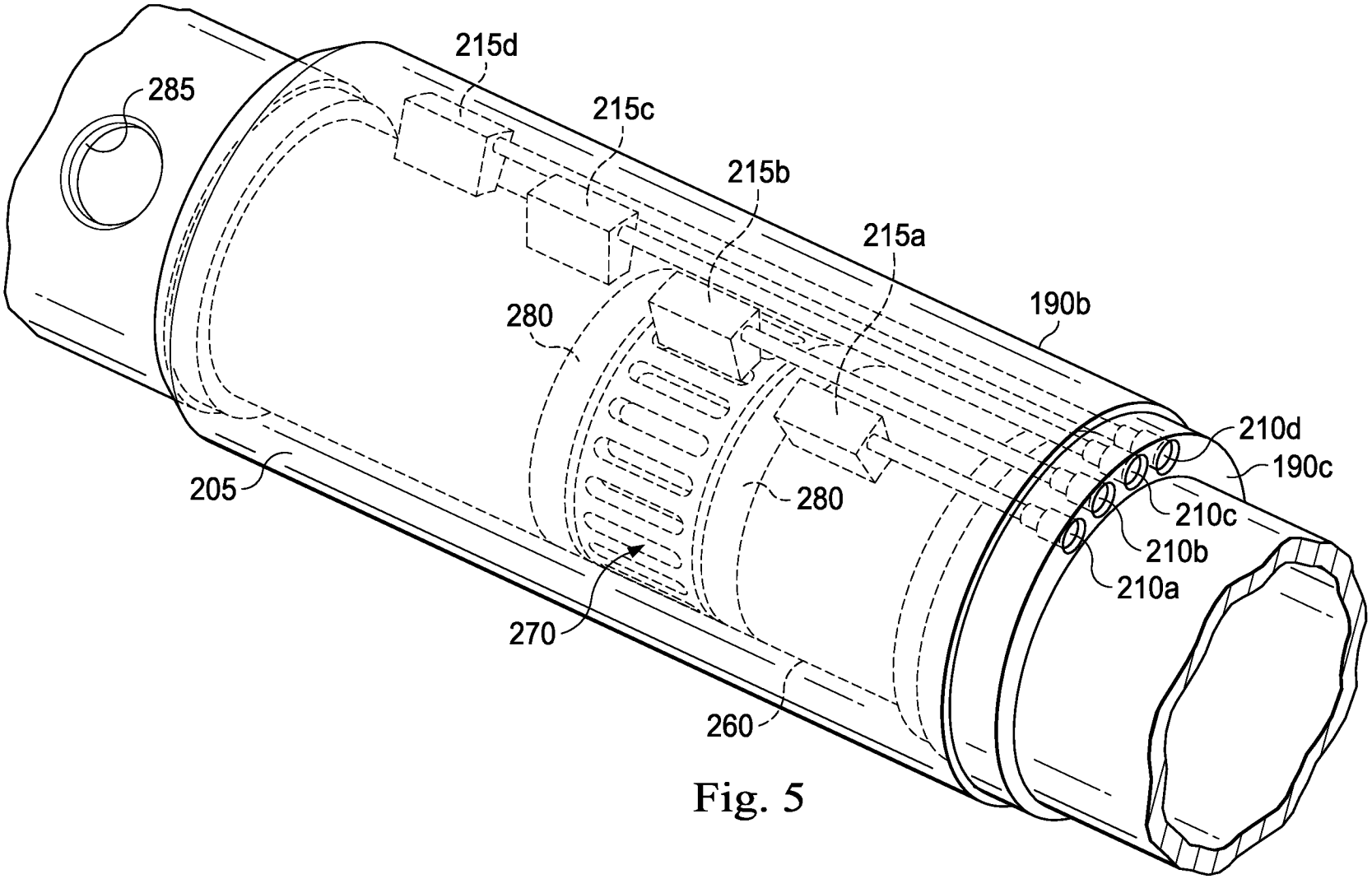
FIG. 5 is perspective view of the flow regulation system of FIG. 1 showing hidden lines, according to an exemplary embodiment of the present disclosure.

FIGS. 3-5 illustrate a more detailed view of the flow regulating system 90 according to an exemplary embodiment. In one or more embodiments, the screen assembly 145 of the flow regulating system 90 is the member 155 (not shown in FIGS. 4 and 5) disposed on an inner tubular member or base pipe 170 so as to define a flow path or passage 175 between the member 155 and the base pipe 170. The passage 175 is formed to direct fluid flow towards the interior flow passage 135 via the ICD 150. An interface ring 180 is disposed about the exterior surface of the screen member 155 to secure the screen member 155 to the base pipe 170. A sleeve 185 is disposed in proximity to and/or about the exterior surface of the base pipe 170 and defines a portion of the passage 175. In an exemplary embodiment, the ICD cover sleeve 185 is removable thereby allowing access to the ICD 150. In some embodiments, the cover sleeve 185 is supported by the interface ring 180. The ICD 150 may be disposed adjacent or in proximity to the member 155 and form a portion of the base pipe 170. In an exemplary embodiment, the ICD 150 is configured to be coupled to the cover sleeve 185.

In an exemplary embodiment, the ICD 150 includes a tubular 190 having an interior flow passage 195 that forms a portion of the interior flow passage 135 or is at least in fluid communication with the interior flow passage 135. A plurality of passageways 200, such as passageways 200*a*, 200*b*, 200*c*, and 200*d* are formed within a wall 205 of the tubular 190. There may be any number of passageways circumferentially spaced within the wall 205. As shown, each of the passageways 200 extends between a port, such as ports 210*a*, 210*b*, 210*c*, and 210*d*, and a chamber, such as chambers 215*a*, 215*b*, 215*c*, and 215*d*. Any number of chambers 215 may be formed within the tubular 190 with any number of flow passages extending between the chambers 215 and ports 210. Generally, each of the chambers 215*a*-215*d* are formed by an internal surface 190*a* of the tubular 190 and are spaced along a longitudinal axis 220 of the interior flow passage 195. That is, each chamber is spaced in a longitudinal direction depicted by the arrow having the reference numeral 225 in FIG. 3. As shown, an external surface 190*b* of the tubular 190 forms a shoulder having a radially extending shoulder surface 190*c* and the ports 210*a*-210*d* extend through the radially extending shoulder surface 190*c*. Often, the radially extending shoulder surface 190*c* and the screen at least partially form the flow path 175. Generally, each of the passageways 200, such as the passageways 200*a* and 200*c*, has a generally tubular shape with a longitudinal axis, such as 230 and 235 (shown in FIG. 4), respectively, that is parallel to the longitudinal axis 220. However, in some embodiments, the longitudinal axes 230 and 235 may face in a radial direction (i.e., perpendicular to the axis 220) or form any angle with the axis 220. Each passageway 200 defines a length measured along the axis 220 between its corresponding port and chamber. For example, the passageway 200*a* has a length 240 between the port 210*a* and the chamber 215*a* and the passageway 200*c* has a length 245 between the port 210*c* and the chamber 215*c*. Generally, the length 240 is less than, or at least different from, the length 245. Each of the chambers 215 is also considered a fluid passage, as fluid passes through the chamber from at least one of the passageways 200 to the interior fluid passage 195 and 135.

The ICD 150 also includes a sliding sleeve 260 that also forms an interior passage 265. The interior passage 265 is in fluid communication with the passage 195. The sliding sleeve 260 includes an opening 270 or a plurality of openings that extends radially through a wall 275 of the sleeve 260. The opening 270 may be positioned between a pair of sealing elements 280. The sliding sleeve 260 is sized to be received within the passage 195 and shiftable in the direction 225 and an opposing direction between a plurality of positions. As shown in FIG. 3, the opening 270 is longitudinally aligned with the chamber 215*a* to place the chamber 215*a* in fluid communication with the passages 265 and 195 while the wall 275 fluidically isolates the chambers 215*b*, 215*c*, and 215*d* from the interior passage 265 and 195 such that the ICD 150 is configured for a first flow setting that is associated with the passageway 200*a* and the first chamber 215*a*. However, the sliding sleeve 260 is shiftable, using a shifting tool or the like (not shown), to a second position as shown in FIG. 5. In the second position, the opening 270 is longitudinally aligned with the second chamber 215*b* to place the second chamber 215*b* in fluid communication with the passages 265 and 195 while the sliding sleeve wall 275 fluidically isolates the chamber 215*a*, 251*c*, and 215*d* from the passages 265 and 195 such that the ICD 150 is configured for the second flow setting that is associated with the chamber 215*b* and the passageway 200*b*. The sliding sleeve 260 can be shifted in the direction 225 and an opposing direction such that the opening 270 is longitudinally aligned with the chamber 215*c* to place the chamber 215*c* (and its corresponding passageway 200*c*) in fluid communication with the passages 265 and 195 while the sliding sleeve wall 275 fluidically isolates the chamber 215*a*, 251*b*, and 215*d* from the passages 265 and 195 such that the ICD 150 is configured for a third flow setting that is associated with the chamber 215*c* and its corresponding passageway 200*c*. The sliding sleeve 260 can be further shifted in the direction 225 and an opposing direction such that the opening 270 is longitudinally aligned with the chamber 215*d* to place the chamber 215*d* (and its corresponding passageway 200*d*) in fluid communication with the passages 265 and 195 while the sliding sleeve wall 275 fluidically isolates the chamber 215*a*, 251*b*, and 215*c* from the passages 265 and 195 such that the ICD 150 is configured for a fourth flow setting that is associated with the chamber 215*d* and its corresponding passageway 200*d*.

Figure 6:
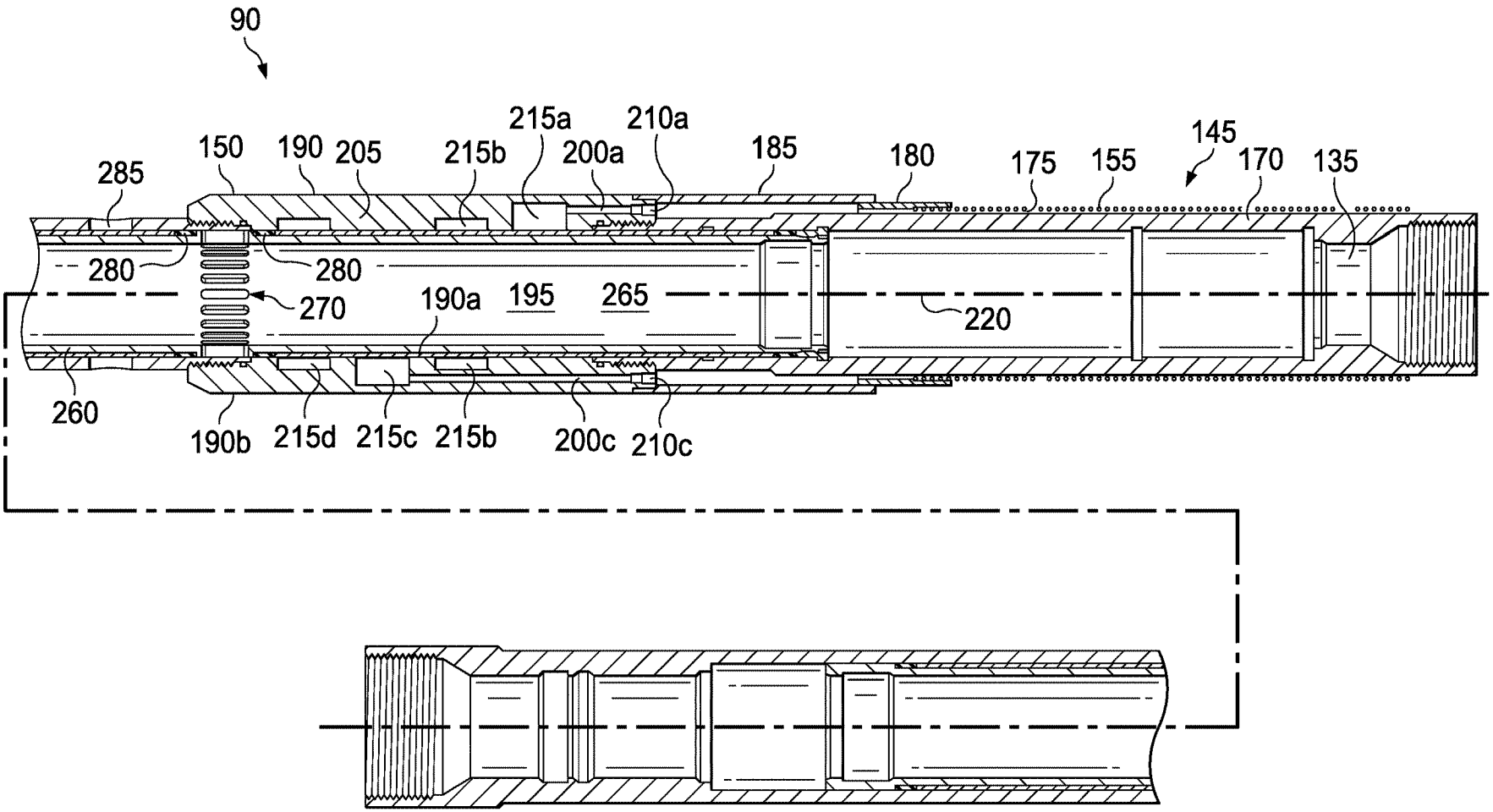
FIG. 6 illustrates a partial sectional view of the flow regulating system of FIG. 2 in a second configuration, according to an exemplary embodiment of the present disclosure.

As shown in FIG. 6, the sliding sleeve 260 can be shifted to a closed position relative to the tubular 190. In the closed position, the opening 270 is not longitudinally aligned with any of the chambers 215*a*-215*d* to fluidically isolate the flow path 175 from the passages 265 and 195.

Figure 7:
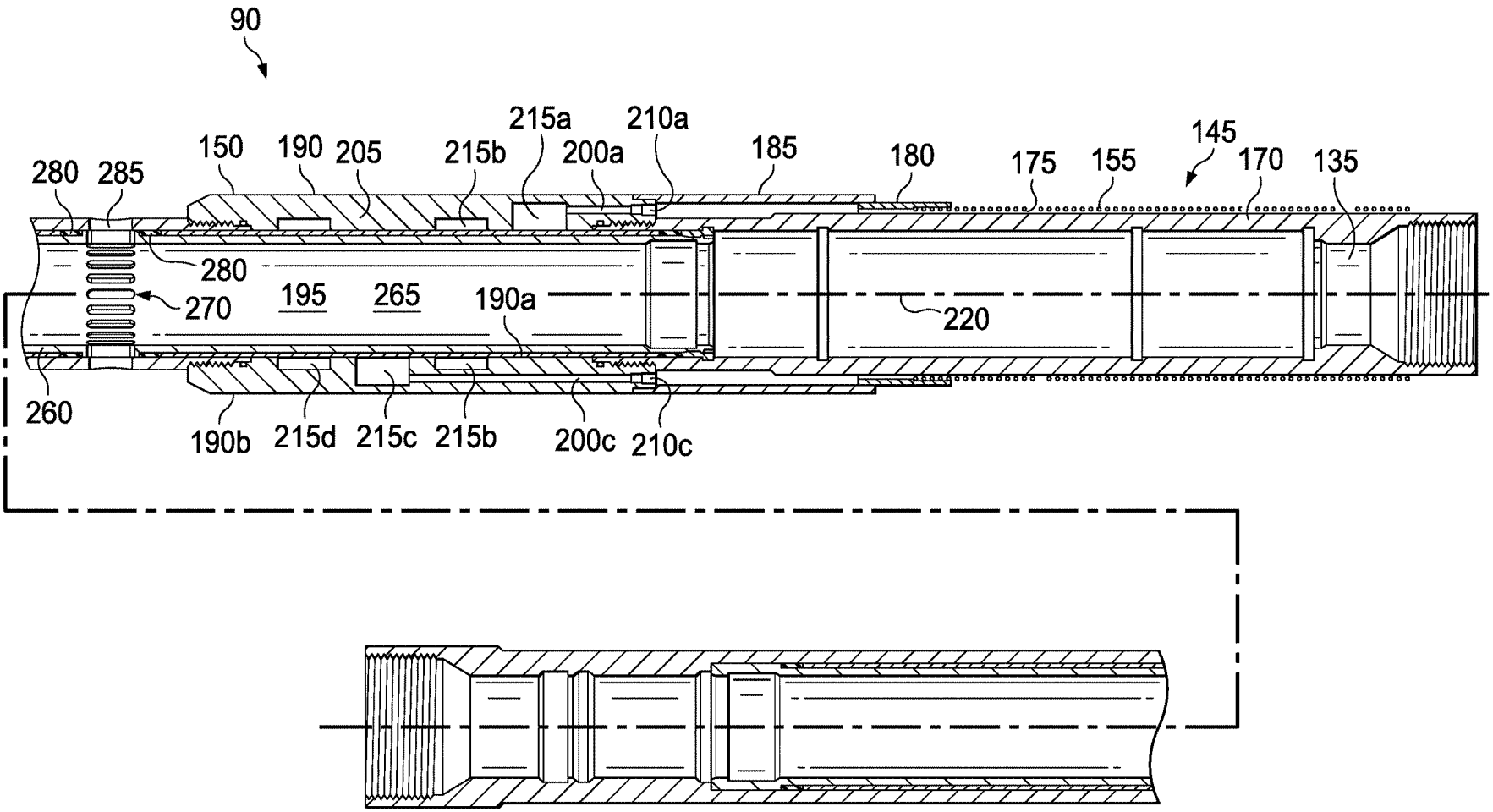
FIG. 7 illustrates a partial sectional view of the flow regulating system of FIG. 2 in a third configuration, according to an exemplary embodiment of the present disclosure.

As shown in FIG. 7, the sliding sleeve 260 can be shifted to a bypass opening position relative to the tubular 190. In the bypass open position, the opening 270 is aligned by a bypass opening 285 formed in the tubular 190 or elsewhere along the tubing string 70. There may be a plurality of bypass open positions in which the opening 270 bypasses the ICD 150 but not the screen member 155, or bypasses the screen member 155 and ICD 150 all together.

Figure 8:
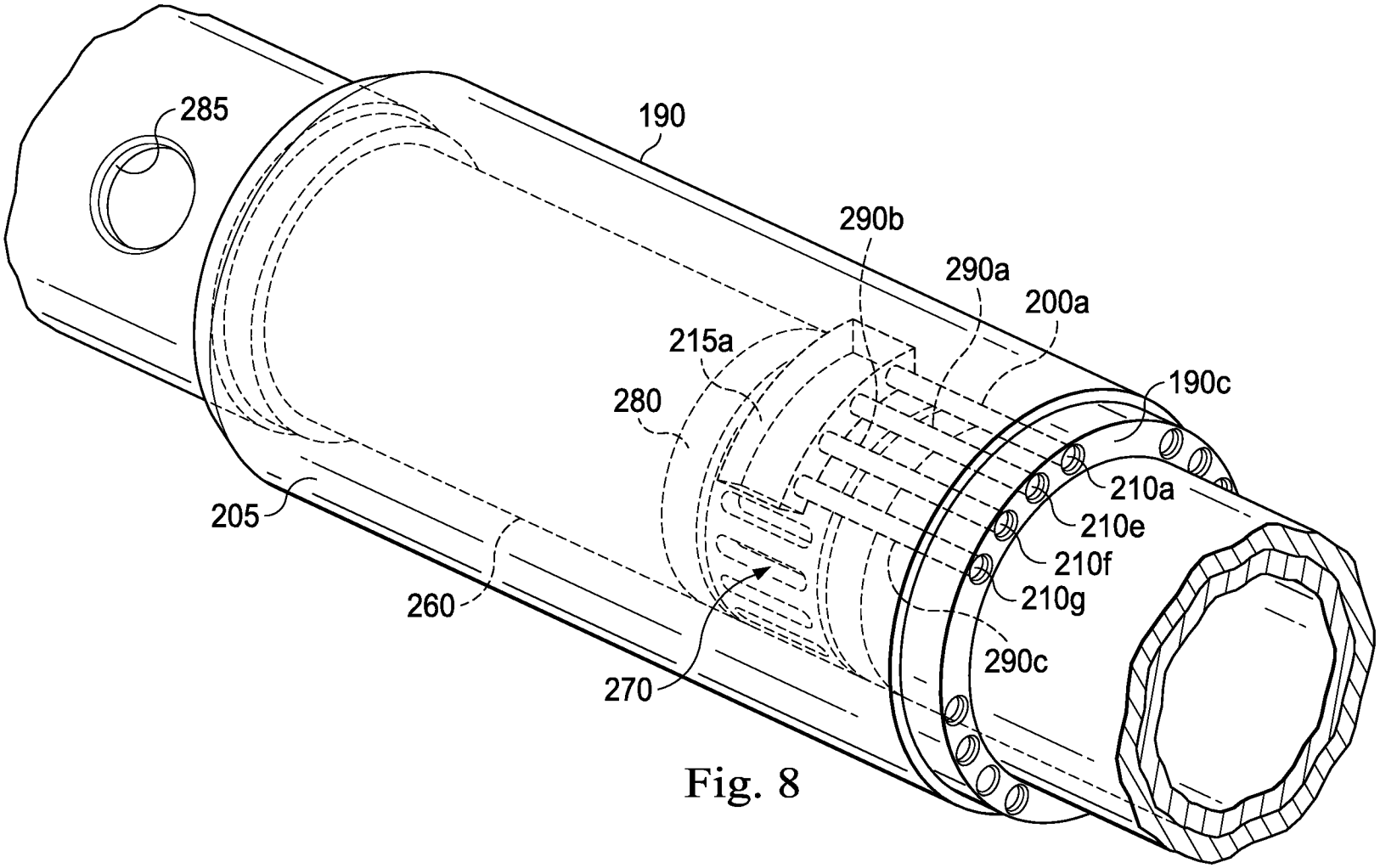
FIG. 8 is perspective view of the flow regulation system of FIG. 1 showing hidden lines, according to another exemplary embodiment of the present disclosure.

As shown in FIG. 8, a plurality of passages may extend from one chamber to the shoulder surface 190*c*. For example and in one embodiment, the passageways 200, 290*a*, 290*b*, 290*c* each extend between the chamber 215*a* and one of ports 210*a*, 210*e*, 210*f*, and 210*g*. Each of the ports 210*a*, 210*e*, 210*f*, and 210*g* is configured to receive a plug. The chamber 215*a* and the ports 210*a*, 210*e*, 210*f*, and 210*g* are associated with a flow setting such that, when formation fluid flows through the ports 210*a*, 210*e*, 210*f*, and 210*g*, the passageway 200*a*, and the chamber 215*a*, a first pressure differential is created between the formation fluid at the ports 210*a*, 210*e*, 210*f*, and 210*g* and the formation fluid at the chamber 215*a*. The flow setting associated with the chamber 215*a* is adjustable with the plugging of one or more of the ports 210*a*, 210*e*, 210*f*, and 210*g*. For example, a first flow setting associated with the chamber 215*a* includes none of the ports 210*a*, 210*e*, 210*f*, and 210*g* being plugged, a second flow setting includes one of the ports 210*a*, 210*e*, 210*f*, and 210*g* being plugged, a third flow setting includes two of the ports 210*a*, 210*e*, 210*f*, and 210*g* being plugged, and a fourth flow setting includes three of the ports 210*a*, 210*e*, 210*f*, and 210*g* being plugged. Each of the first, second, third, and fourth settings are different. Each of the flow settings has a predetermined number of ports to be plugged and each of the flow settings is associated with an expected pressure differential or actual pressure differential.

Figure 9:
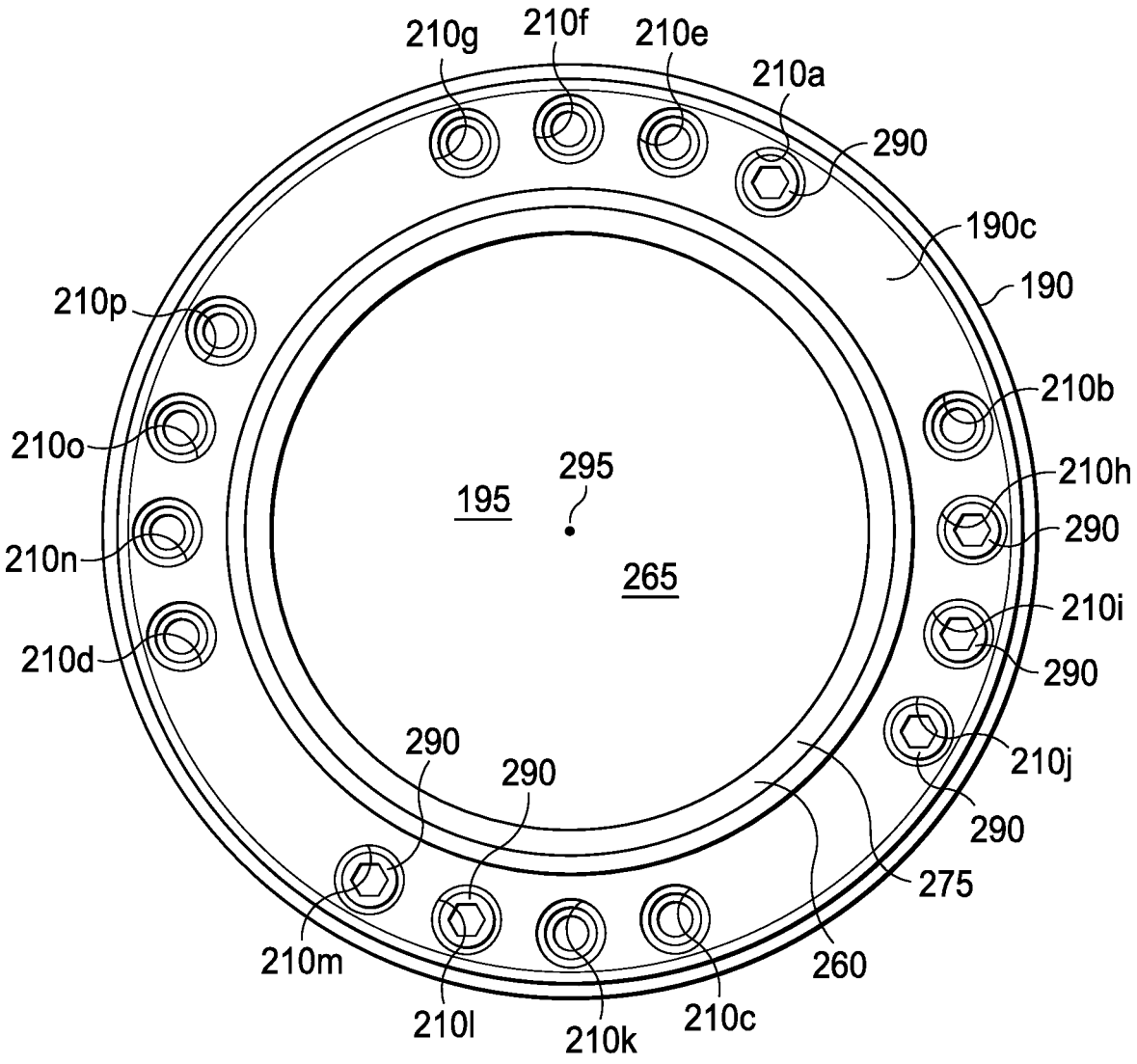
FIG. 9 illustrates a cross sectional view of the flow regulating system of FIG. 2, according to an exemplary embodiment of the present disclosure.

As shown in FIG. 9, a plurality of passages may extend from each of the chambers 215*b*-215*d* to the shoulder surface 190*c* via ports in a similar manner to the passages 200*a*, 200*e*, 200*f*, and 200*g*. Thus, a passage extends from each of ports 210*h*-210*j* to the chamber 215*b*; a passage extends from each of ports 210*k*-210*m* to the chamber 215*c*; and a passage extends from each of ports 210*n*-210*p* to the chamber 215*d*. Plugs 290 may be inserted into the ports 210*h*-210*j* so that the chamber 215*b* is associated with a predetermined flow setting and pressure differential; plugs 290 are inserted into ports 210*l* and 210*m* so that the chamber 215*c* is associated with predetermined flow setting and pressure differential; and no plugs are inserted into the ports 210*d* and 210*n*-210*p* so that the chamber 215*d* is associated with a predetermined flow setting and pressure differential. Thus, as the conditions in the well change over the life of the well, the sleeve 260 can be shifted into the first, second, third, or fourth position so that the ICD 150 is associated with any number of different flow settings and its corresponding pressure differentials. As shown, the ports 210*a*-210*p* are circumferentially spaced within the wall 205 of the tubular 190 but longitudinally aligned. Moreover, the longitudinal axis 295 of the tubular 190 aligns with the longitudinal axis 300 of the sliding sleeve 260.

Figure 10:
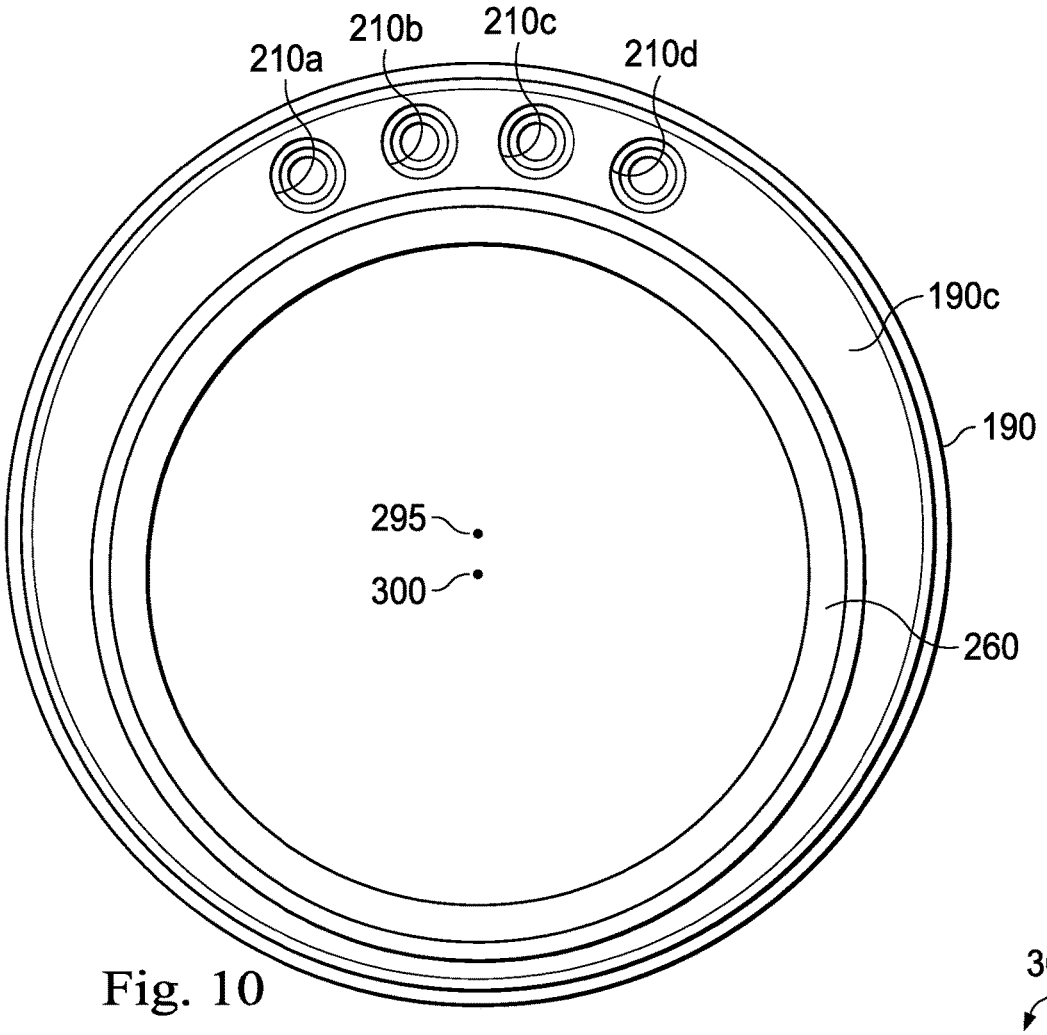
FIG. 10 illustrates a cross sectional view of the flow regulating system of FIG. 2, according to another exemplary embodiment of the present disclosure.

As shown in FIG. 10, a longitudinal axis 295 of the tubular 190 is parallel to and offset from the longitudinal axis 300 of the sliding sleeve 260.

Figure 11:
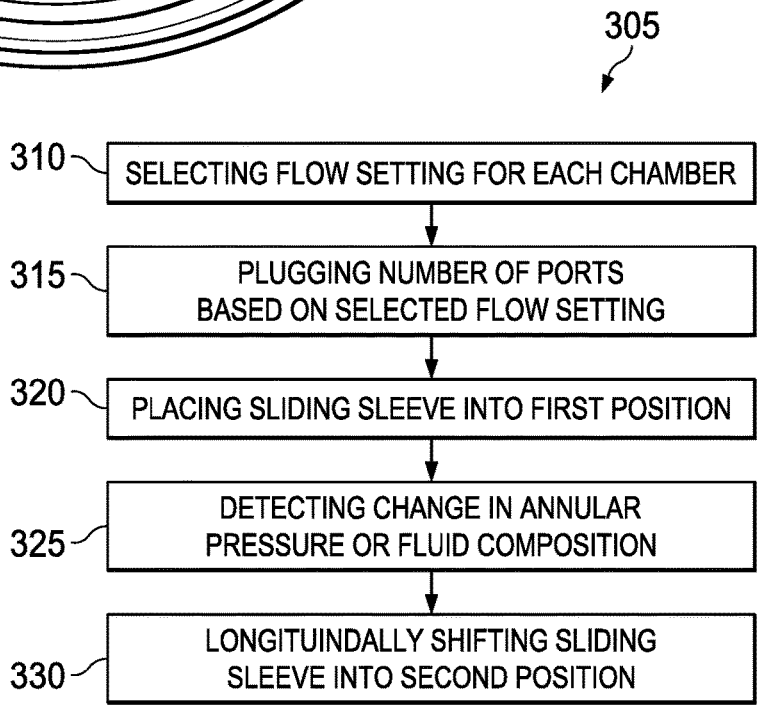
FIG. 11 is a flow chart illustration of a method of operating the apparatus of FIGS. 1-10, according to an exemplary embodiment.

In an exemplary embodiment, as illustrated in FIG. 11 with continuing reference to FIGS. 1-10, a method 305 of operating the inflow control device 150 includes selecting a flow setting for each of the chambers 215*a*-215*d* at step 310; plugging a number of ports based on each selected flow setting at step 315; placing the sliding sleeve 260 into the first position at step 320 and run the ICD 150 into the well; detecting a change in pressure or fluid composition within the annulus 140 at step 325; and longitudinally shifting the sliding sleeve 260 into the second position at step 330.

At the step 310, a flow setting is selected for each of the chambers 215*a*-215*d*. The flow setting selected for each of the chambers 215*a*-215*d* is different from the others of the chambers 215*a*-215*d* and are based, at least in part, on the number of ports, from the group of ports associated with each of the chambers, to be plugged. As a different number of ports can be plugged to result in different flow settings, there are a variety or number of flow setting options associated with each of the chambers 215*a*-215*d*.

Figure 12:
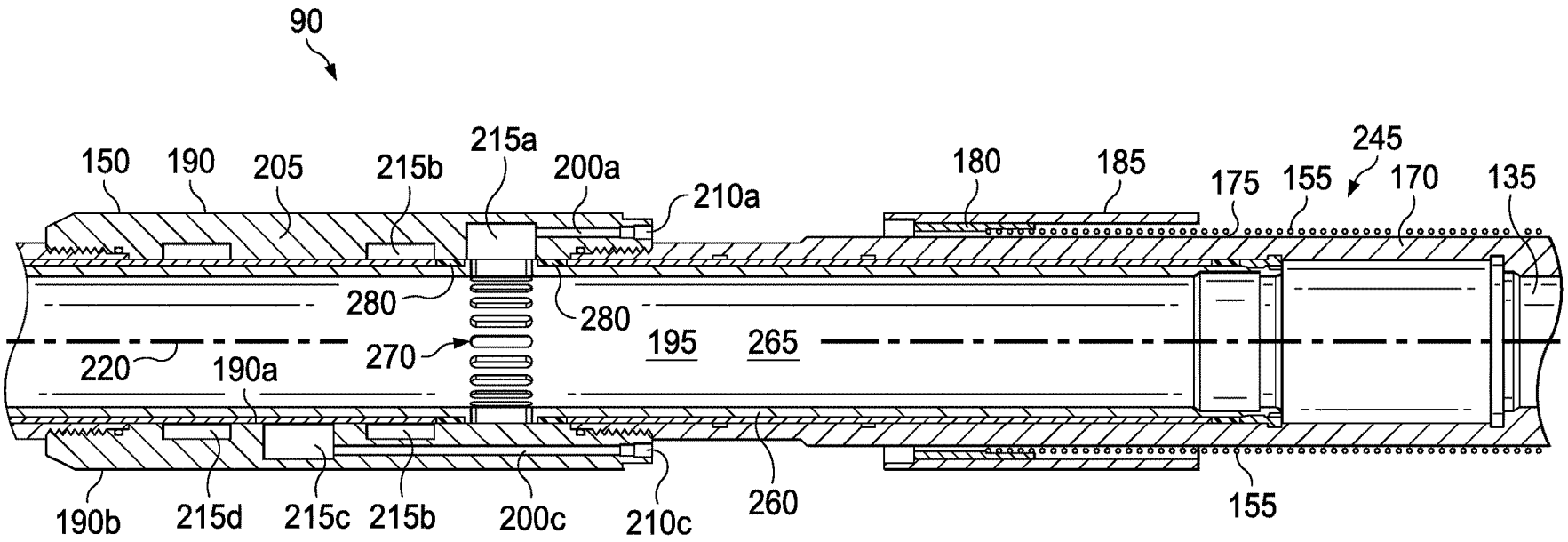
FIG. 12 illustrates a partial sectional view of the flow regulating system of FIG. 2 in a fourth configuration, according to an exemplary embodiment of the present disclosure.

At the step 315, a number of ports, from the group of ports associated with each of the chambers, is plugged based on each selected flow setting. In some embodiments, the adjustment of the flow settings occurs at the surface of the well. That is, a number of ports can be plugged at the surface of the well. In an exemplary embodiment and as shown in FIG. 12, the cover sleeve 185 can be moved relative to the tubular 190 to expose the shoulder surface 190*c* and the ports 210*a*-210*p*, thereby allowing an operator to plug a number of the ports 210*a*-210*p*.

At the step 320, the sliding sleeve 260 is placed into the first position. In the first position, the formation fluid flows from the annulus 140, through the passageway 200*a* and into the passages 195 and 265 (and thus to the passage 135) to create a first pressure differential between a pressure within the annulus 140 and a pressure within the passages 195 and 265. In some embodiments, the pressure differential is created between a fluid pressure exerted on the external surface 190*b* of the tubular 190 and an internal pressure within the passage 265.

At the step 325, a change is detected in the pressure within the annulus 140. A change in pressure within the annulus 140 or a change in formation fluid composition or both may be detected during the life of the well.

At the step 330, the sliding sleeve 260 is longitudinally shifted into the second position. In response to the change detected, the sliding sleeve 260 is longitudinally shifted into the second position. In the second position, the formation fluid flows from the annulus 140, through the passageway 200*a* and into the passages 195 and 265 (and thus to the passage 135) to create a pressure differential between the pressure within the annulus 140 and the pressure within the passages 195 and 265. In an exemplary embodiment, longitudinally shifting the sliding sleeve 260 from the first position to the second position and from the second position to the third position is independent from relative rotation between the sliding sleeve 260 and the tubular 190. In an exemplary embodiment, longitudinally shifting the sliding sleeve 260 relative to the tubular 190 comprises coupling a shifting tool (not shown) to the sliding sleeve 260. In an exemplary embodiment, the internal surface 190*a* of the tubular 190 forms a plurality of detents and the sliding sleeve 260 forms corresponding keys such that the keys of the sliding sleeve 260 are locked into one or more of the detents of the tubular 190 when in the first, second, third, fourth, etc. position.

In some embodiments, the method 305 continues to include shifting the sliding sleeve 260 relative to the tubular 190 into the third and the fourth positions, with each position having a different flow setting and pressure differential, in response to detecting a change in the pressure within the annulus or change of formation fluid composition. Moreover, the method 305 includes shifting from the second position into the first position or any variation of shifting positions, including the open and the closed position.

While four chambers 215*a*-215*d* are shown, any number of chambers may be included or formed in the tubular 190. Moreover, any number of passageways or passages could extend between each chamber and the external surface 190*b* of the tubular 190. Additionally, the longitudinal shifting of the sliding sleeve 260 relative to the tubular 190 is not limited to a shifting tool, but instead may be pressure actuated via hydraulic lines, etc.

In an exemplary embodiment, during the operation of the apparatus 150 and/or the execution of the method 305, the ICD 150 can cycle between fully open, fully closed, or a plurality of configured pressure differential settings as desired, thereby allowing for increased control of the tool's flow characteristics while being adjustable in the well via wireline or e-line tools. In an exemplary embodiment, the ICD 150 utilizes a multi-position sliding sleeve 260 to allow passage through at least one flow path, or to completely close the valve prohibiting flow to communicate. In an exemplary embodiment, the ICD 150 is configured to shift between an open and a closed position, with the ability to cycle between any number of additional positions, wherein each additional position provides a differing pressure drop. In an exemplary embodiment, the ability to select and configure the ICD 150 allows the user to install multiple flow control device settings into a single tool and shift between them as needed during the life of the well.

Thus a method of controlling a flow of a formation fluid through an inflow control device including a tubular within which a sliding sleeve having a longitudinal fluid passageway extends has been described. Embodiments of the method may generally include aligning a radial opening formed within the sliding sleeve into a first position relative to the tubular, such that the formation fluid flows through a first fluid passage formed through a wall of the tubular and into the longitudinal fluid passageway of the sliding sleeve to create a first pressure differential between an external pressure applied to an external surface of the tubular with an internal pressure within the longitudinal fluid passage; longitudinally shifting the sliding sleeve relative into a second position relative to the tubular, to align the radial opening with a second fluid passage formed through the wall of the tubular to allow the formation fluid to flow through the second fluid passage and into the longitudinal fluid passageway thereby creating a second pressure differential between the external pressure and the internal pressure; and longitudinally shifting the sliding sleeve into a third position relative to the tubular, to align the radial opening with a third fluid passage formed through the wall of the tubular to allow the formation fluid to flow through the first fluid passage and into the longitudinal fluid passageway thereby creating a third pressure differential between the external pressure and the internal pressure; wherein each of the first, second, and third pressure differentials are different from another of the first, second, and third pressure differentials Any of the foregoing embodiments may include any one of the following elements, alone or in combination with each other:

- The first fluid passage is in fluid communication with a first plurality of fluid passages, wherein each fluid passage of the first plurality of fluid passages includes a port formed through the external surface of the tubular; and each port associated with the first plurality of fluid passages is configured to receive a plug.
- Selecting a first flow setting option from a plurality of flow setting options, each flow setting option from the plurality of flow setting options having a different number of ports to be plugged; wherein the first flow setting option has a predetermined number of ports in the first plurality of fluid passages to be plugged; and plugging the predetermined number of ports in the first plurality of fluid passages to be plugged; and the first flow setting is associated with the first pressure differential.
- The second fluid passage is in fluid communication with a second plurality of fluid passages, wherein each fluid passage of the second plurality of fluid passages includes a port formed through the external surface of the tubular.
- Each port associated with the second plurality of fluid passages is configured to receive a plug.
- Selecting a second flow setting option from the plurality of flow setting options; wherein the second flow setting option has a predetermined number of ports to be plugged in the second plurality of fluid passages to be plugged.
- Plugging the predetermined number of ports to be plugged in the second plurality of fluid passages.
- The second flow setting is associated with the second pressure differential.
- Plugging the predetermined number of ports to be plugged in the first plurality of fluid passages and plugging the predetermined number of ports to be plugged in the second plurality of fluid passages occurs at the surface of a well into which the inflow control device is received.
- All ports are circumferentially spaced within the wall of the tubular and all ports are longitudinally aligned within the tubular.
- Each fluid passage in the first plurality of fluid passages and in the second plurality of fluid passages has a generally tubular shape that has a longitudinal axis that is parallel to and offset from a longitudinal axis of the longitudinal fluid passageway.
- Longitudinally shifting the sliding sleeve from the first position to the second position and from the second position to the third position is independent from relative rotation between the sliding sleeve and the tubular.

Each fluid passage from the first plurality of fluid passages has a shorter length than each fluid passage from the second plurality of fluid passages.

Longitudinally shifting the sliding sleeve relative to the tubular includes coupling a shifting tool to the sliding sleeve.

Detecting a change in the external pressure or fluid composition; and wherein longitudinally shifting the sliding sleeve into the second position and/or into the third position is in response to the detected change.

Thus, a multi-position inflow control device has been described. Embodiments of the multi-position inflow control device may generally include a tubular forming a first interior passage, the tubular having a wall within which a first passage and a second passage longitudinally extend; wherein the first passage extends between a first port that is formed in an external surface of the tubular and a first chamber that is formed in an internal surface of the tubular; wherein the second passage extends between a second port that is formed in the external surface of the tubular and a second chamber formed in the interior surface of the tubular; wherein the first passage has a first length in a longitudinal direction and the second passage has a second length in the longitudinal direction that is different from the first length; wherein the first chamber and the first passage are associated with a first flow setting; wherein the second chamber and the second passage are associated with a second flow setting that is different from the first flow setting; and wherein the first chamber is spaced from the second chamber in the longitudinal direction; and a sliding sleeve forming a second interior passage, the sliding sleeve having an opening that extends radially through a wall of the sliding sleeve; wherein the sliding sleeve is sized to be received within the first interior passage and shiftable in the longitudinal direction between a first position and a second position; wherein, when in the first position, the opening is longitudinally aligned with the first chamber to place the first chamber in fluid communication with the second interior passage while the wall of the sliding sleeve fluidically isolates the second chamber from the second interior passage such that the inflow control device is configured for the first flow setting; and wherein, when in the second position, the opening is longitudinally aligned with the second chamber to place the second chamber in fluid communication with the second interior passage while the wall of the sliding sleeve fluidically isolates the first chamber from the second interior passage such that the inflow control device is configured for the second flow setting Any of the foregoing embodiments may include any one of the following elements, alone or in combination with each other:

A first plurality of passages and a second plurality of passages also extend longitudinally within the wall of the tubular; each passage in the first plurality of passages extends between one port from a first plurality of ports formed in the external surface of the tubular and the first chamber; each passage in the second plurality of passages extends between one port from a second plurality of ports formed in the external surface of the tubular and the second chamber; each passage of the first plurality of passages has the first length and each passage in the second plurality of passages has the second length; each passage of the first plurality of passages and the second plurality of passages is configured to receive a plug; the first flow setting is further associated with the first plurality of passages, and the insertion of a plug in one or more of the passages of the first plurality of passages adjusts the first flow setting; and the second flow setting is further associated with the second plurality of passages, and the insertion of a plug in one or more of the passages of the second plurality of passages adjusts the second flow setting.

The first and second ports are circumferentially spaced and longitudinally aligned within the wall of the tubular.

The external surface of the tubular forms a shoulder having a radially extending shoulder surface; wherein the first and second ports extend through the radially extending shoulder surface.

The inflow control device is coupled to a screen; and wherein the radially extending shoulder surface of the tubular and the screen at least partially form a fluid passage.

The sliding sleeve is shiftable, between the first position and the second position, independent of relative rotation between the sliding sleeve and the tubular.

Each of the first and second passages has a generally tubular shape with a longitudinal axis that is parallel to the first interior passage.

A longitudinal axis of the first interior passage is parallel to and offset from a longitudinal axis of the tubular.

A longitudinal axis of the first interior passage coincides with a longitudinal axis of the tubular.

The sliding sleeve is shiftable between the first position and the second position multiple times.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several exemplary embodiments, while different steps, processes, and procedures are described as appearing as distinct acts, one or more of the steps, one or more of the processes, and/or one or more of the procedures could also be performed in different orders, simultaneously and/or sequentially. In several exemplary embodiments, the steps, processes and/or procedures could be merged into one or more steps, processes and/or procedures.

It is understood that variations may be made in the foregoing without departing from the scope of the disclosure. Furthermore, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method of controlling a flow of a formation fluid through an inflow control device comprising a tubular within which a sliding sleeve having a longitudinal fluid passageway extends, the method comprising:

aligning a radial opening formed within the sliding sleeve into a first position relative to the tubular, such that the formation fluid flows through a first fluid passage formed through a wall of the tubular and into the longitudinal fluid passageway of the sliding sleeve to create a first pressure differential between an external pressure applied to an external surface of the tubular with an internal pressure within the longitudinal fluid passageway;

longitudinally shifting the sliding sleeve into a second position relative to the tubular, to align the radial opening with a second fluid passage formed through the wall of the tubular to allow the formation fluid to flow through the second fluid passage and into the longitudinal fluid passageway thereby creating a second pressure differential between the external pressure and the internal pressure;

and longitudinally shifting the sliding sleeve into a third position relative to the tubular, to align the radial opening with a third fluid passage formed through the wall of the tubular to allow the formation fluid to flow through the third fluid passage and into the longitudinal fluid passageway thereby creating a third pressure differential between the external pressure and the internal pressure;

wherein each of the first, second, and third pressure differentials are different from another of the first, second, and third pressure differentials.

2. The method of claim 1, wherein the first fluid passage is in fluid communication with a first plurality of fluid passages, wherein each fluid passage of the first plurality of fluid passages includes a port formed through the external surface of the tubular; and wherein each port associated with the first plurality of fluid passages is configured to receive a plug;

wherein the method further comprises:

selecting a first flow setting option from a plurality of flow setting options, each flow setting option from the plurality of flow setting options having a different number of ports plugged to be plugged; wherein the first flow setting option has a predetermined number of ports in the first plurality of fluid passages to be plugged; and plugging the predetermined number of ports in the first plurality of fluid passages to be plugged;

and wherein the first flow setting is associated with the first pressure differential.

3. The method of claim 2, wherein the second fluid passage is in fluid communication with a second plurality of fluid passages, wherein each fluid passage of the second plurality of fluid passages includes a port formed through the external surface of the tubular; and wherein each port associated with the second plurality of fluid passages is configured to receive a plug;

wherein the method further comprises:

selecting a second flow setting option from the plurality of flow setting options; wherein the second flow setting option has a predetermined number of ports to be plugged in the second plurality of fluid passages to be plugged; and plugging the predetermined number of ports to be plugged in the second plurality of fluid passages;

and wherein the second flow setting is associated with the second pressure differential.

4. The method of claim 3, wherein plugging the predetermined number of ports to be plugged in the first plurality of fluid passages and plugging the predetermined number of ports to be plugged in the second plurality of fluid passages occurs at the surface of a well into which the inflow control device is received.

5. The method of claim 3, wherein all ports are circumferentially spaced within the wall of the tubular and all ports are longitudinally aligned within the tubular.

6. The method of claim 3, wherein each fluid passage in the first plurality of fluid passages and in the second plurality of fluid passages has a generally tubular shape that has a longitudinal axis that is parallel to and offset from a longitudinal axis of the longitudinal fluid passageway.

7. The method of claim 1, wherein longitudinally shifting the sliding sleeve from the first position to the second position and from the second position to the third position is independent from relative rotation between the sliding sleeve and the tubular.

8. The method of claim 3, wherein each fluid passage from the first plurality of fluid passages has a shorter length than each fluid passage from the second plurality of fluid passages.

9. The method of claim 1, wherein longitudinally shifting the sliding sleeve relative to the tubular comprises coupling a shifting tool to the sliding sleeve.

10. The method of claim 1, further comprising detecting a change in the external pressure or formation fluid composition; and wherein longitudinally shifting the sliding sleeve into the second position and/or into the third position is in response to the detected change.

11. A multi-position inflow control device, the inflow control device comprising:

a tubular forming a first interior passage, the tubular having a wall within which a first passage and a second passage longitudinally extend;

wherein the first passage extends between a first port that is formed in an external surface of the tubular and a first chamber that is formed in an internal surface of the tubular;

wherein the second passage extends between a second port that is formed in the external surface of the tubular and a second chamber formed in the interior surface of the tubular;

wherein the first passage has a first length in a longitudinal direction and the second passage has a second length in the longitudinal direction that is different from the first length;

wherein the first chamber and the first passage are associated with a first flow setting;

wherein the second chamber and the second passage are associated with a second flow setting that is different from the first flow setting;

and wherein the first chamber is spaced from the second chamber in the longitudinal direction;

and a sliding sleeve forming a second interior passage, the sliding sleeve having an opening that extends radially through a wall of the sliding sleeve;

wherein the sliding sleeve is sized to be received within the first interior passage and shiftable in the longitudinal direction between a first position and a second position;

wherein, when in the first position, the opening is longitudinally aligned with the first chamber to place the first chamber in fluid communication with the second interior passage while the wall of the sliding sleeve fluidically isolates the second chamber from the second interior passage such that the inflow control device is configured for the first flow setting;

and wherein, when in the second position, the opening is longitudinally aligned with the second chamber to place the second chamber in fluid communication with the second interior passage while the wall of the sliding sleeve fluidically isolates the first chamber from the second interior passage such that the inflow control device is configured for the second flow setting.

12. The inflow control device of claim 11, wherein a first plurality of passages and a second plurality of passages also extend longitudinally within the wall of the tubular;

wherein each passage in the first plurality of passages extends between one port from a first plurality of ports formed in the external surface of the tubular and the first chamber;

wherein each passage in the second plurality of passages extends between one port from a second plurality of ports formed in the external surface of the tubular and the second chamber;

wherein each passage of the first plurality of passages has the first length and each passage in the second plurality of passages has the second length;

wherein each passage of the first plurality of passages and the second plurality of passages is configured to receive a plug;

wherein the first flow setting is further associated with the first plurality of passages, and the insertion of a plug in one or more of the passages of the first plurality of passages adjusts the first flow setting;

and wherein the second flow setting is further associated with the second plurality of passages, and the insertion of a plug in one or more of the passages of the second plurality of passages adjusts the second flow setting.

13. The inflow control device of claim 11, wherein the first and second ports are circumferentially spaced and longitudinally aligned within the wall of the tubular.

14. The inflow control device of claim 11, wherein the external surface of the tubular forms a shoulder having a radially extending shoulder surface; wherein the first and second ports extend through the radially extending shoulder surface.

15. The inflow control device of claim 14, wherein the inflow control device is coupled to a screen; and wherein the radially extending shoulder surface of the tubular and the screen at least partially form a fluid passage.

16. The inflow control device of claim 11, wherein the sliding sleeve is shiftable, between the first position and the second position, independent of relative rotation between the sliding sleeve and the tubular.

17. The inflow control device of claim 11, wherein each of the first and second passages has a generally tubular shape with a longitudinal axis that is parallel to the first interior passage.

18. The inflow control device of claim 11, wherein a longitudinal axis of the first interior passage is parallel to and offset from a longitudinal axis of the tubular.

19. The inflow control device of claim 11, wherein a longitudinal axis of the first interior passage coincides with a longitudinal axis of the tubular.

20. The inflow control device of claim 11, wherein the sliding sleeve is shiftable between the first position and the second position multiple times.

* * * * *